US006308833B1

(12) United States Patent
Oravez

(10) Patent No.: US 6,308,833 B1
(45) Date of Patent: Oct. 30, 2001

(54) FOOD PACKAGING SYSTEM

(75) Inventor: Thomas P. Oravez, Chicago, IL (US)

(73) Assignee: Kraft Foods, Inc., Chicago, IL (US)

( * ) Notice: Subject to any disclaimer, the term of this patent is extended or adjusted under 35 U.S.C. 154(b) by 0 days.

(21) Appl. No.: 09/512,109

(22) Filed: Feb. 24, 2000

(51) Int. Cl.[7] ..... A45C 11/20

(52) U.S. Cl. ..... 206/541; 206/557; 229/903; 426/114

(58) Field of Search ..... 206/541, 557, 206/438, 363, 562, 563; 229/903, 902, 904, 905, 906; 426/110, 114, 124, 125

(56) References Cited

U.S. PATENT DOCUMENTS

| | | | | |
|---|---|---|---|---|
| D. 354,655 | | 1/1995 | Daenen et al. . | |
| 4,201,795 | * | 5/1980 | Yamanaka | 426/110 |
| 4,697,703 | * | 10/1987 | Will | 206/485 |
| 4,750,619 | * | 6/1988 | Cohen et al. | 206/438 |
| 4,813,543 | * | 3/1989 | Goldberg | 206/507 |
| 5,165,947 | * | 11/1992 | Colucci et al. | 426/124 |
| 5,375,701 | | 12/1994 | Hustad et al. . | |
| 5,565,228 | * | 10/1996 | Gics | 426/107 |
| 5,772,031 | * | 6/1998 | Landis | 206/438 |
| 5,868,253 | * | 2/1999 | Krueger et al. | 206/438 |

* cited by examiner

*Primary Examiner*—Shian T. Luong
(74) *Attorney, Agent, or Firm*—Fitch, Even, Tabin & Flannery

(57) ABSTRACT

A food packaging system for a food product such as an uncooked deep dish pizza includes an aluminum pan for receiving the food product. A paperboard ring is placed over the upper rim of the pan to provide a local shield, retarding the cooking time of the upper outer edge of the food product. Together, the pan and ring form a cooking vessel for the food product. A formed tray of plastic material receives the pan and provides pocket-like stepped recesses to aid in cushioning the pan and to hold the ring in desired position about the pan rim. A support member is applied to the bottom and one end of the tray to provide a bottom support for positioning the tray and its contents, on-edge, in an upright position. A film covers the contents of the tray and is removed, along with the tray and support member, to prepare the food product for cooking.

23 Claims, 7 Drawing Sheets

FOOD PACKAGING SYSTEM

BACKGROUND OF THE INVENTION

1. Field of the Invention

The present invention relates to food packaging systems and in particular to packaging of food products such as an uncooked deep dish pizza product in which either frozen or non-frozen uncooked pizza ingredients are carried within a semi-rigid pan.

2. Description of the Related Art

The present invention relates to packaging for uncooked pizza food products and especially deep dish pizzas. Relatively thin pizzas are available in frozen form and are provided to the consumer in different stages of preparedness, but generally require some amount of baking time before they can be eaten. Uncooked pizzas are provided in either fully prepared form or can be provided as an assemblage of ingredients, as shown for example in U.S. Pat. No. 5,747,084. When provided in an uncooked but fully prepared form, deep dish pizzas present certain challenges to a manufacturer, to ensure that the consumer will be able to enjoy a well prepared pizza without requiring inconvenient or complex cooking procedures with which the consumer may not be familiar. Further, it is desirable that the consumer be required only to unwrap the pizza and place it in a heated oven for a set period of time.

As mentioned above, uncooked pizzas may be presented to the consumer in either frozen or unfrozen form. Obviously, different types of food storage equipment must be provided by the food store for accommodating both types of pizza packages. Frozen pizzas may be stored in an open top freezer or in an enclosed freezer chest, while the non-frozen refrigerated pizza product may be stored in a refrigerated cabinet. In order to provide added value to a food store, food manufacturers have packaged their products as stand-alone attractive self-display advertising units. For example, the package for an uncooked pizza may feature a colorful photograph of the finished, baked pizza, which would attract the consumer's interest.

SUMMARY OF THE INVENTION

It is important that the food packages provided to a food store be readily adapted to conventional package handling by store personnel. For example, uncooked pizzas have been provided in the form of a "flat package" in which the pizza packages are stacked one on top of another in order to conserve space within a freezing or refrigerated environment. This type of package handling does not fully utilize the visual display of the package's advertising features. The invention enables a package be presented to the consumer standing in an upright fashion so that the full impact of promotional and advertising features of the product may be displayed to the consumer.

One example of a stand-up food package is found in U.S. Pat. No. 5,375,701 in which a flat compartmentalized package containing snack foods, breakfast foods or the like is provided with a card, which cooperates with the package top, to allow the package to stand on end, in an upright fashion. Such packages are unsuitable for use with specialty products such as deep dish pizzas in either frozen or non-frozen refrigerated form.

It is an object of the present invention to provide a food packaging system for use with uncooked pizzas and especially pizzas of the deep dish type, in either fully assembled, partially assembled or unassembled ingredient form.

Another object of the present invention is to provide a packaging system of the type mentioned above having provision for being made to readily stand on-end in an upright position.

A further object of the present invention is to provide a packaging system of the type mentioned above which provides a baking vessel for the pizza food product.

These and other objects of the present invention are provided in a packaging system for a food product such as a deep dish pizza, comprising in combination:

- a pan for holding the food product, the pan having a bottom wall, a side wall and an upper outwardly extending rim;
- a shield member disposed about the rim of the pan so as to shield the outer periphery of food product disposed in the pan during cooking;
- a support tray defining a stepped recess, and a bottom wall at a bottom of the stepped recess, for securing the pan, food product and shield member, with a first recess portion receiving the side wall of the pan and a second recess portion for receiving the rim of the pan and the shield member;
- a support member including a body portion contacting the bottom wall of the tray, the support member further including a pair of laterally spaced apart wings hingedly joined to the body portion and an end wall also hingedly joined to the body portion, the wings and the end wall foldable so as to form a pocket for receiving a part of at least one of the tray recess portions; and
- a protective film disposed about the tray so as to cover the food product and shield member.

DETAILED DESCRIPTION OF THE PREFERRED EMBODIMENT

Figure 1:
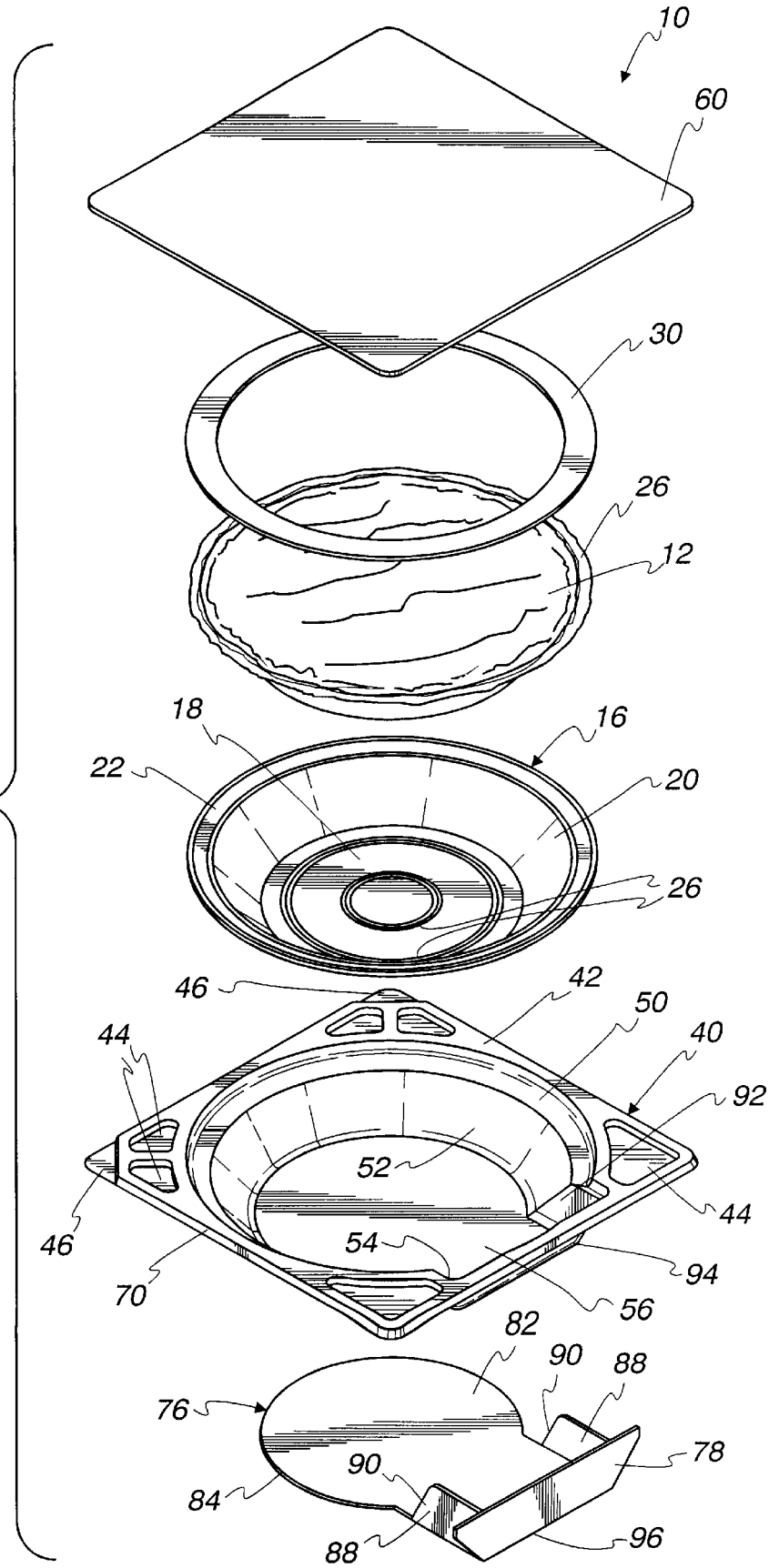
FIG. 1 is an exploded perspective view of a packaging system according to principles of the present invention.
Figure 2:
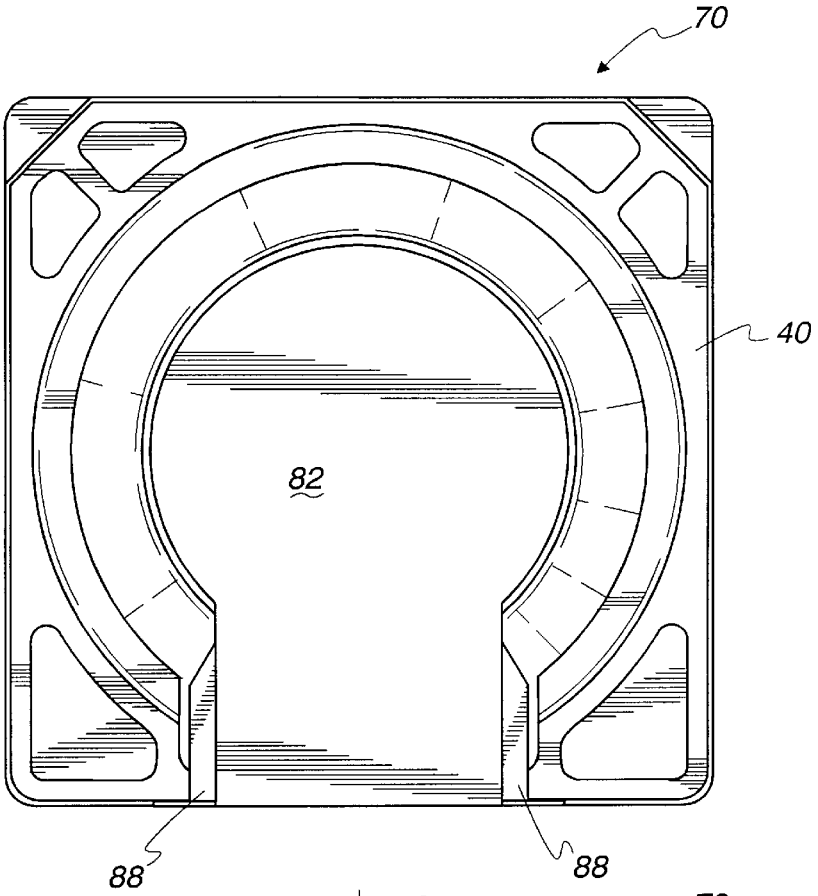
FIG. 2 is a rear elevational view thereof.
Figure 3:
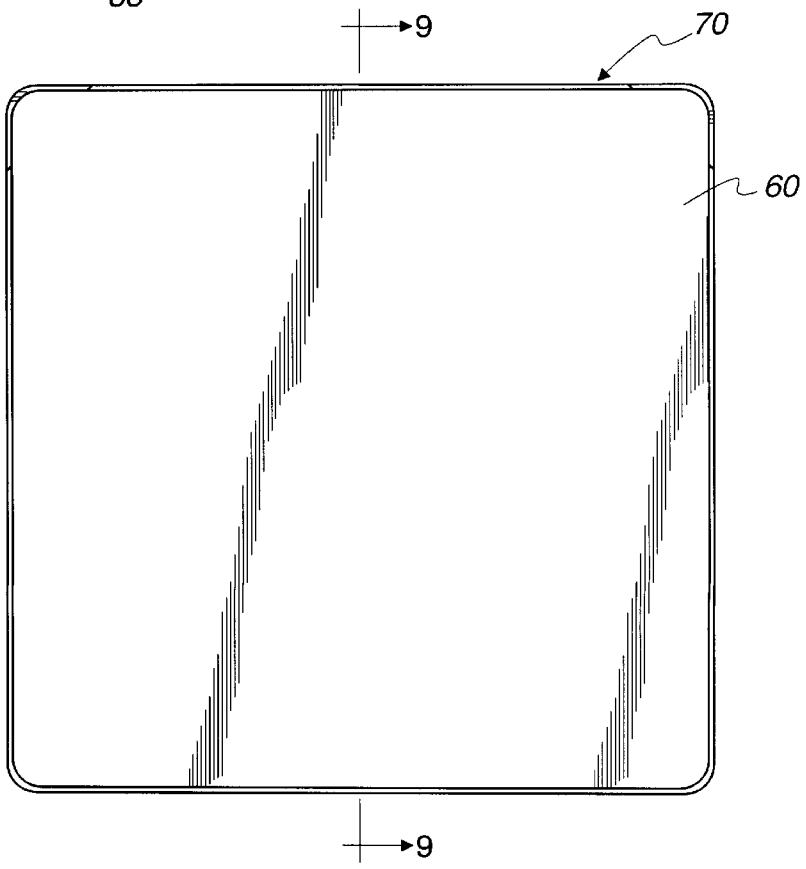
FIG. 3 is a front elevation view thereof.
Figure 4:
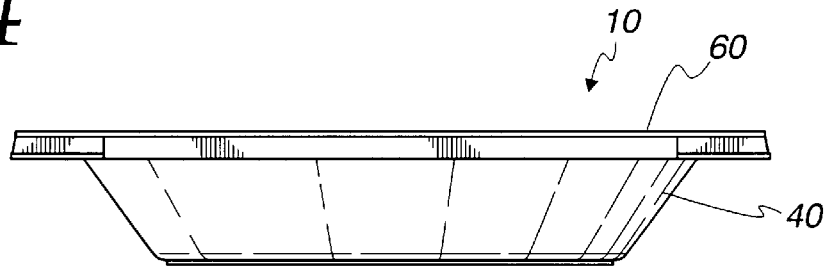
FIG. 4 is a top plan view thereof.
Figure 5:
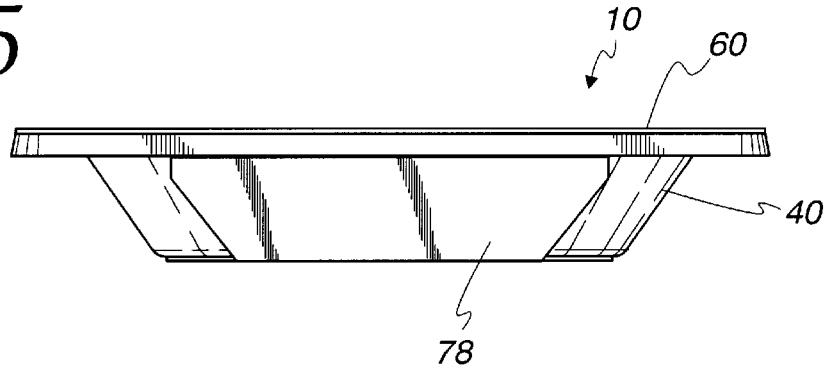
FIG. 5 is a bottom plan view thereof.
Figure 6:
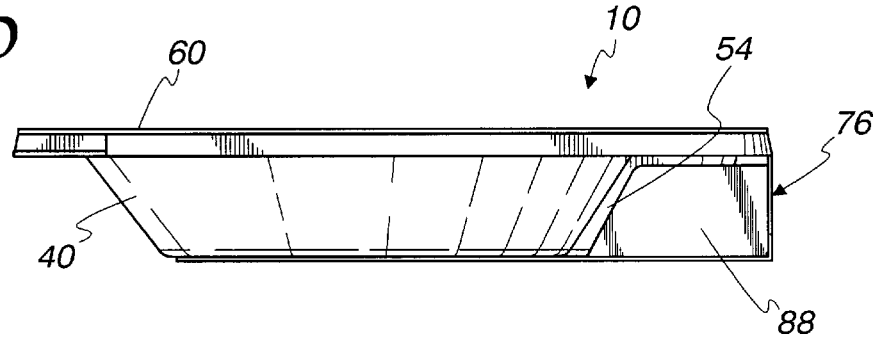
FIG. 6 is an elevational view taken from one side thereof.
Figure 7:
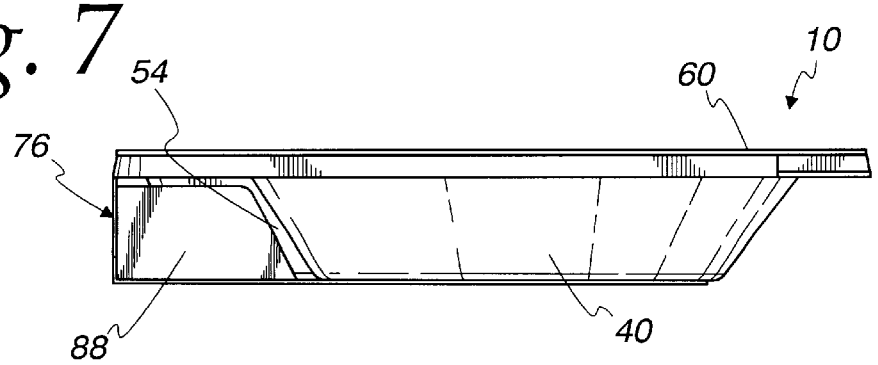
FIG. 7 is an elevational view taken from the other side thereof.

Referring now to the drawings, FIG. 1 shows a packaging system 10 for a food product 12. The packaging system 10, as will be seen herein, protects the food product 12 in transit to the consumer. In addition, packaging system 10 provides a cooking vessel within which the food product is cooked. In the preferred embodiment, directed to the packaging of a deep dish pizza, the preferred mode of cooking the product is baking in a conventional bake oven for a predetermined amount of time. As will be seen herein, a portion of packaging system 10 is used to carry out the baking operation.

Figure 10:
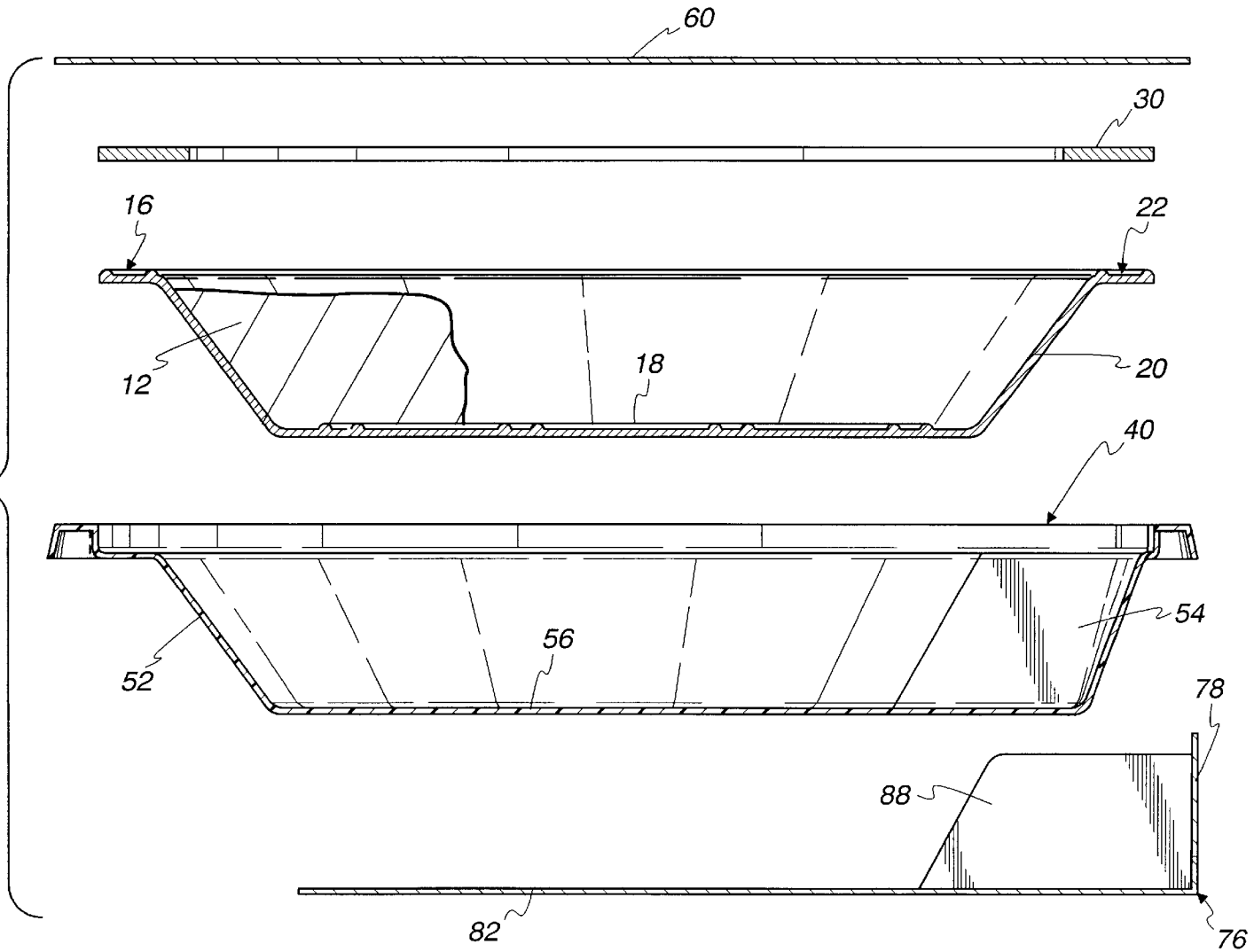
FIG. 10 is a view similar to that of FIG. 9 shown in exploded form.

As will be appreciated, the deep dish pizzas are relatively heavy and, in an unfrozen state, include a substantial mass of flowable filling disposed within a crust, either partially cooked or uncooked. As with traditional restaurant pizzas, it is anticipated that the crust surrounding the pizza filling lacks the requisite strength and rigidity to contain the pizza filling, unassisted. Accordingly, there is provided an aluminum pan 16 having a relatively flat bottom wall 18, a frustoconical side wall 20 and an annular top wall or rim 22. As indicated in FIG. 10, food product 12 does not fill the entire volume of pan 16, but rather has a top surface lying beneath rim 22. Bottom wall 18 of pan 16 has a plurality of reinforcing rings 26 which aid in enhancing the rigidity of bottom wall 18. Preferably, pan 16 is formed of relatively thin aluminum material. Pan 16 has a rigidity similar to that of conventional aluminum foil pans. The outer rim 22 of pan 16 can be readily crushed or bent if inadvertently contacted during shipping or tipped on edge while being made to bear the weight of the preferred deep dish pizza food product.

As mentioned, pan 16 serves as a cooking vessel for the deep dish pizza product, which, along with pan 16, is placed in a conventional baking oven. The upper portion 26 of the pizza crust will bake more quickly than the thicker much more massive pizza filling and remaining crust, even though the upper edge 26 of the pizza product is located below the top of pan 16. In order to increase the convenience to the consumer and to alleviate the undesirability of uneven cooking, a shield or ring 30 is added to pan 16 to form part of the cooking vessel for the food product. Preferably, ring 30 is supported by outer rim 22 of pan 16 and rests atop rim 22, preferably out of contact with the upper surface of food product 12. If food product 12 is made to entirely fill pan 16, up to the level of rim 22, rim 22 of ring 30 can be provided with stand-offs to prevent the ring from contacting the food product. Ring 30 can be made from virtually any suitable material, such as pressed aluminum or aluminum foil, but is preferably made from an ovenable paperboard material. When baking of the food product is completed, pan 16 is removed from the oven and ring 30 is thereafter removed and discarded, leaving the food product ready for serving.

As mentioned, the rim 22 of pan 16 is preferably made from a pressed aluminum foil material and hence is susceptible to bending and crushing when a substantial force is applied thereto. In order to prevent such damage from occurring during shipping, and to prevent the need for shippers and store personnel to employ unusual care in handling, a supporting tray generally indicated at 40 is provided as part of the packaging system. Tray 40 is preferably formed of plastic, using conventional thermoforming techniques or other conventional methods. Tray 40 has an outer periphery or top wall 42 with a plurality of reinforcing pockets 44 and depressed corners 46. Tray 40 is provided with a central stepped recess structure. A recess 50 has a generally L-shape in cross-section and is dimensioned so as to receive rim 22 in a nesting fashion as can be seen, for example, in FIG. 9.

Tray 40 further includes a second recess or frustoconical side wall 52 dimensioned for a close tolerance nesting fit with the side wall 20 of pan 16. A rectangular pocket 54 extends outwardly from wall 54 to allow a user easy access to pan 16, to facilitate its extraction. Tray 40 further includes a bottom wall 56 which preferably is a complete wall, joined to side wall 52. Although less preferred, bottom wall 56 can be formed with a central opening or, in certain instances, can be eliminated altogether. In the preferred embodiment, tray 40 is configured so that bottom wall 56 provides continuous support for bottom wall 18 of pan 16 as can be seen, for example, in FIG. 9. Therefore, in the preferred embodiment, tray 40 is dimensioned to provide continuous underlying support for the rim, side wall and bottom wall of pan 16, and for the components supported by pan 16 such as the food product 12 and ring 30.

Figure 9:
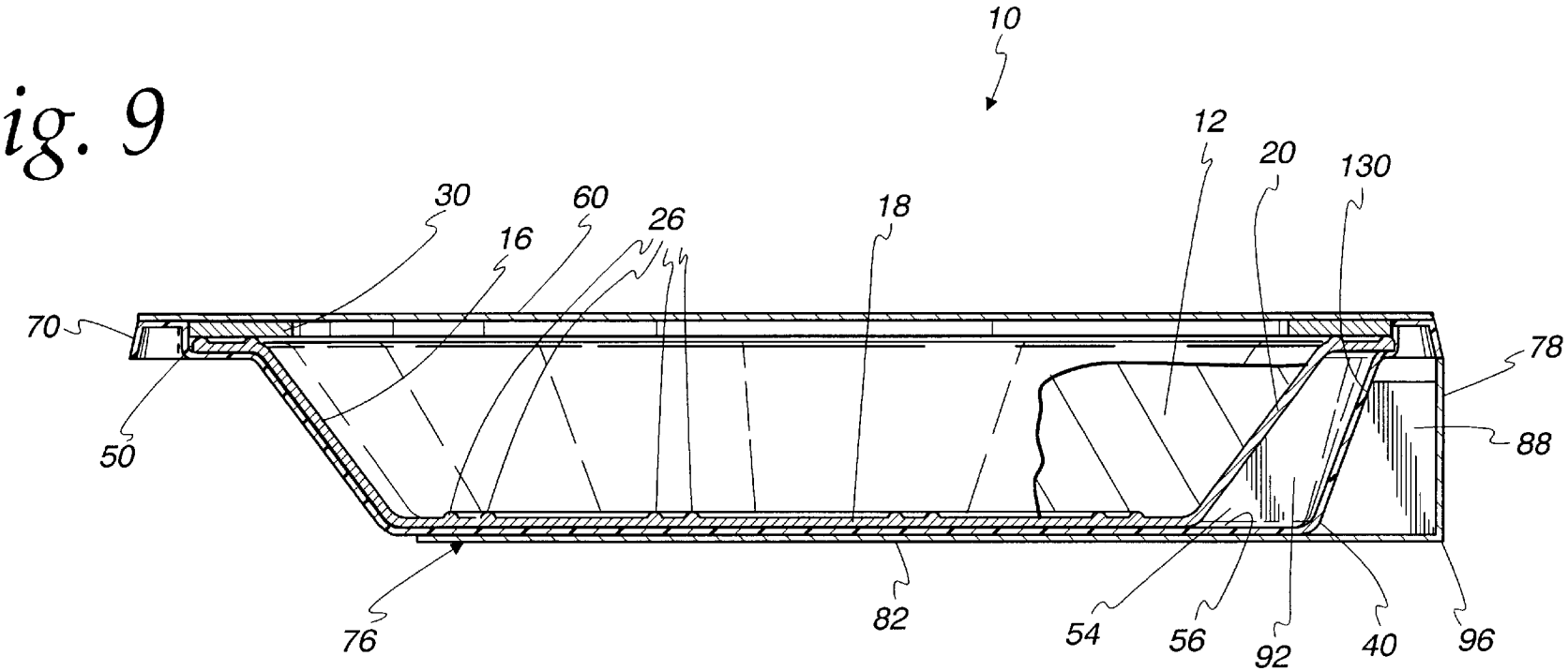
FIG. 9 is a cross-sectional view taken along the line 9—9 of FIG. 3.

A flexible film 60 is provided to cover food product 12. Preferably, film 60 is secured to the upper wall 42 of tray 40 using conventional thermal joining techniques, although other conventional techniques such as shrink wrapping or adhesive joinder can be employed. Less preferably, film 60 can be replaced by a rigid or semi-rigid panel of suitable material, such as paper-board, plastic or metal foil. In the preferred embodiment, the corners of film 60 extend to the corner of tray 40. In order to provide convenience to the consumer, it is generally preferred that film 60 remains separate from ring 30 and food product 12. Referring to FIG. 9, it can be seen that rim 22 of pan 16 and ring 30 cooperate to space foil 60 above the food product. Accordingly, a relatively thin film can be stretched tightly over tray 40 and secured thereto to provide an effective but lightweight barrier in which contact between the film and the food product is effectively avoided.

Additional advantages are provided by the packaging system described above. For example, the outer rim 22 of pan 16 can be provided with an upstanding lip to provide seating engagement with ring 30, maintaining the ring in position during preparation of the packaging system as well as during the baking or other cooking of the food product. Alternatively, a low strength joinder between the ring and rim can be employed using conventional thermal adhesive or other joining techniques. Such maintenance of the ring position with respect to pan 16 is also important for any gas flushing or the like procedures prior to shipment of the food product. Retention of ring 30 is preferably provided by the recessed rim 50 of tray 40 as can be seen, for example, in FIG. 9. Preferably, the upper surface 42 of tray 40 is made continuously flat or planar so as to facilitate the automated dispensing and placement of film 60 over the top of tray 40. As can be seen for example in FIG. 1, the upper portion 42 of tray 40 extends a substantial distance beyond the outer edge of pan 16 allowing the tray to be supported from below during the application of the film covering 60.

If desired, the afore-described package components can be used to ship the food product as long as it is required only that the package be readily flat-stackable for storage in transit or in a food store's freezer or refrigerated cabinet. According to additional aspects of the present invention, provision is made for the self-supporting free standing disposition of the packaging system. As mentioned, tray 40 protects rim 22 of pan 16 when the package is tipped on end, preventing crushing of rim 22. With the package tipped on end, unstable contact is made with an outer edge 70 of the tray upper wall 42.

With reference to FIG. 9, for example, tipping the left hand edge of the packaging system on end would render the packaging system unstable due to the relatively thin dimension of peripheral edge 70 of tray 40 and the mass of the food product located off-center with respect to the tray edge 70. Accordingly, with reference to FIG. 9 there is provided a support member generally indicated at 76. Support member 76 includes a support surface 78 extending substantially the entire height of the packaging system. As will be appreciated by those skilled in the art, it is important that support member 76 be maintained in position with respect to tray 40 and the remainder the packaging system and food product. For example, it is important that the support member not be allowed to shift or bend as this would allow the packaging system to become unbalanced when placed on end in an upright position, with wall 78 of support member 76 serving as the bottom support surface. The support member 76 and tray 40, as well as film 60 are removed prior to baking of the food product.

Figure 8:
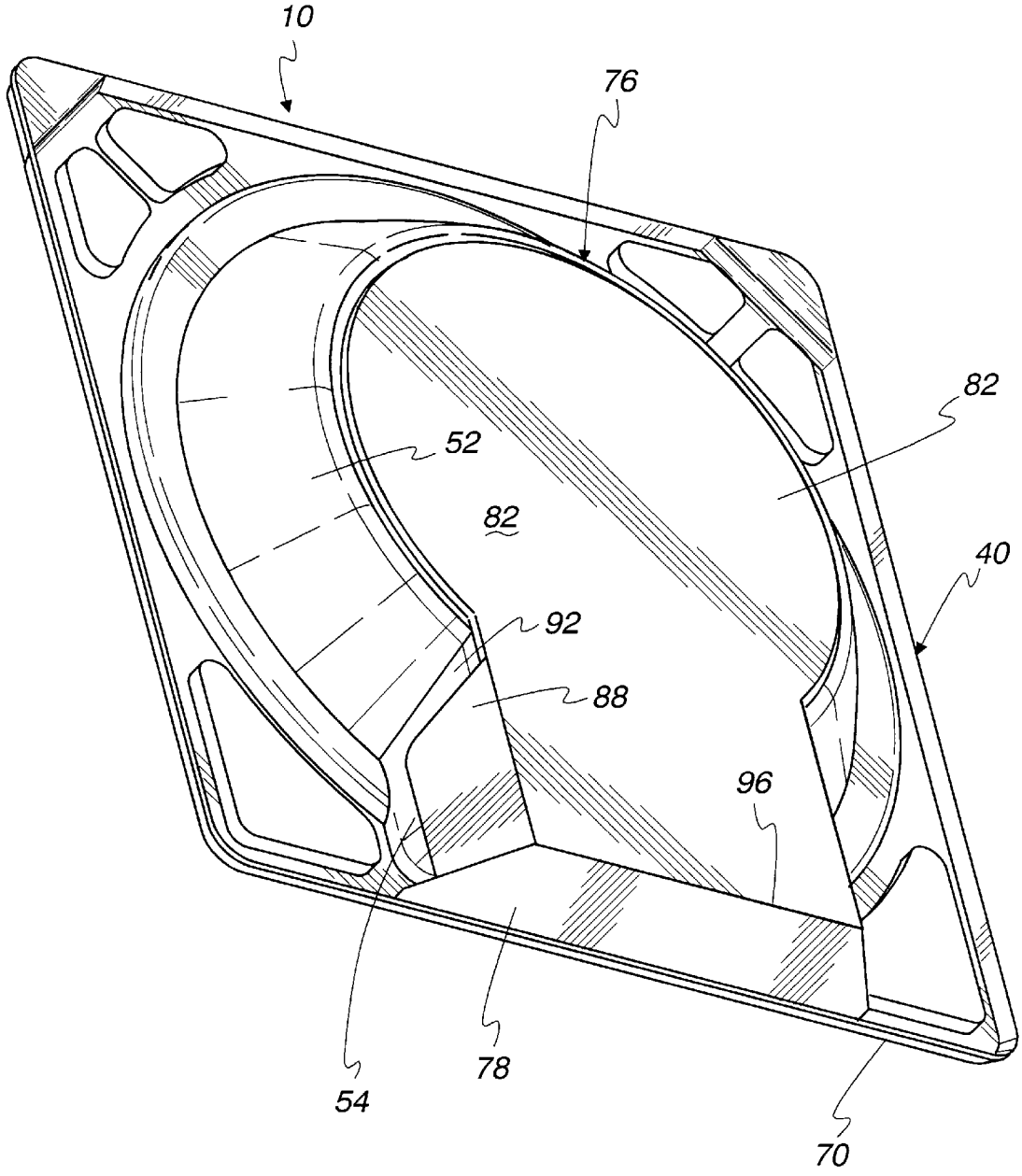
FIG. 8 is a perspective view thereof.
Figure 11:
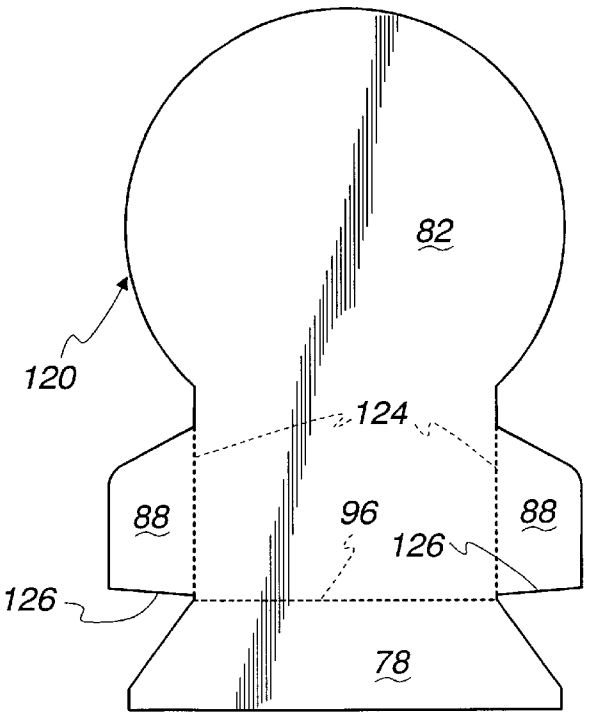
FIG. 11 is a top plan view of a support member therefor.

Turning now to FIGS. 1, 8 and 11, additional features of support member 76 will be discussed. As can be seen, support member 76 is provided with a relatively large sized body portion 82 having a part circular edge 84 corresponding to the bottom wall 56 of tray 40. Body portion 82 is preferably secured to bottom wall 56 of tray 40 using adhesive or other joining techniques.

As can be seen in FIG. 11, the support member 76 is preferably formed from a paperboard blank 120. As seen, the body portion 82 and end wall 78 are joined by a line of weakness forming hinge 96. Wings 88 are joined to body portion 82 by respective weakened lines 124 which form a conventional hinge line when the wings are folded in the manner indicated in FIG. 8. Wings 88 include angled edges 90 and bottom edges 126. The wings are folded so as to engage the sides 92 of pocket 54 which extends from side wall 52 of tray 40.

With reference to FIG. 8, in the preferred embodiment, end wall 78 and body portion 82 are joined together along a fold line 96. It is important to manage the amount of bending along fold line 96, that is, the angle between body portion 82 and end wall 78 of support member 76 in order to maintain tray 40 and the food product disposed therein at a stable balanced upright position. End wall 78 in the preferred embodiment is generally trapezoidal shaped and has a free edge engaging tray 40 adjacent the outer rim 70. A joinder or adhesive engagement between body portion 82 for wings 88 and tray 40 comprises one way (although not the most preferred way) of assuring the desired angular configuration for the packaging system.

Figure 12:
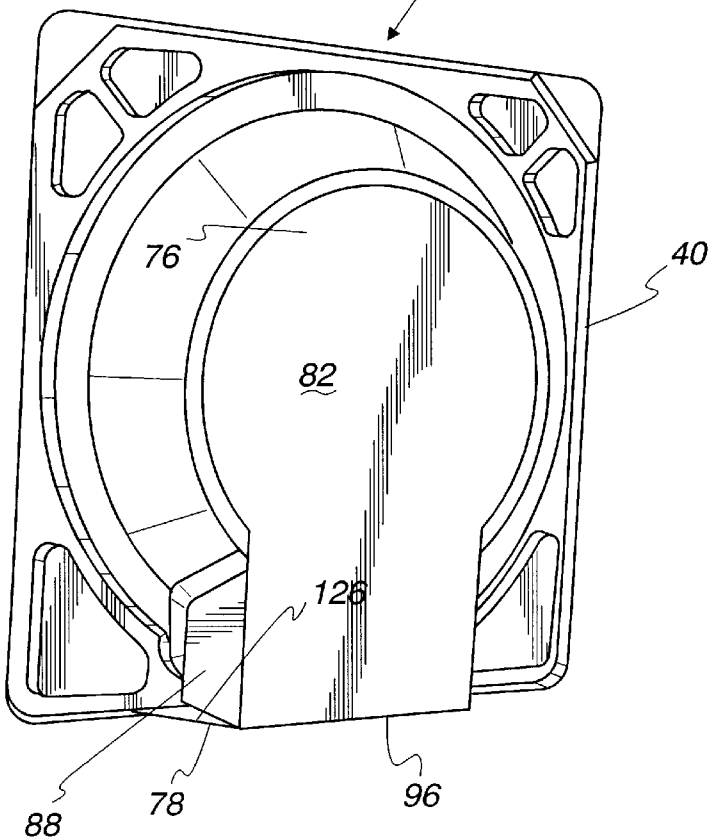
FIG. 12 is another perspective view of the packaging system.

As can be seen in FIG. 12, body portion 82 and end wall 78 are folded about hinge line 96 so as to bring the bottom edges 126 of wings 88 into abutting engagement with end wall 78, fixing the upright position of the packaging system. If desired, the abutting engagement of wings 88 and end wall 78 alone can be relied upon to determine the upright angle of the packaging system. Tape or adhesive joinder can be employed to maintain the abutting engagement of these two members, if desired. Alternatively, an adhesive or other joinder of the bottom wall and either the wings or body portion, or both, of support member 76 with tray 40 can be relied upon to establish the upright position of the packaging system.

As can be seen in FIG. 9, the rear wall 78 and the lower part of body portion 82 are spaced from the side wall portion 130 of tray 40. This adds a cushioning for the food product and pan 16. As can also be seen in FIG. 9, side wall portion 130 of tray 40 is spaced a substantial distance from wall 20 of pan 16 providing further cushioning of the pan and food product.

Referring to FIGS. 8 and 9, it is generally preferred that the wings 88 and end wall 78 be folded so as to cooperate with body portion 82, forming a pocket engaging walls 92 and the bottom wall 56 of tray 40. As mentioned, wings 88 overlie and preferably engage walls 92 and may be secured thereto with adhesive or other conventional joining techniques, if desired. Such adhesive joinder between wings 88 and wings 82 of tray 40 would provide a desired support for card member 76 at the desired upright angle so as to securely balance the packaging system and food product in an upright position.

As can now be seen herein, the support member 76 has a "keyhole" shape with a first circular portion and a second rectangular portion extending therefrom. The support member, as explained above, includes further features to allow the food packaging system to be placed on-end in an upright position, resting against bottom wall 78. The support member, as can be seen in FIG. 8, also allows clearance of the user's fingers to access the sidewalls of the tray, and the tray includes a pocket extending from its side wall facilitating the extraction of the pan and food product therefrom.

The present invention also contemplates certain alternative constructions in addition to those previously described. As mentioned above, the annular ring or shield 30 has been shown nested within a stepped recess of tray 40. However, the present invention also contemplates that the outer rim 22 of pan 16 include an upturned border forming a stepped recess for receiving the shield 30 to support the shield in place during cooking, to prevent scorching the crust of the deep dish pizza food product.

As a further alternative, the construction illustrated in FIG. 9 can be modified to provide a simplified food product packaging system. If desired, the paperboard support 76 can be omitted and the wall 130 of the tray can be arranged to form an angle with tray wall 56 of approximately 90 degrees so as to provide one-edge standing support as well as an opening at the upper end to allow introduction of a user's fingers to the underside of the pan, allowing easy removal from the tray.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims

What is claimed is:

1. A food product packaging system comprising in combination:

a pan for holding the food product, the pan having a bottom wall, a side wall and an upper outwardly extending rim;

a support tray defining a central cavity and a bottom wall at the bottom of the central cavity, the support tray securing the pan and the food product;

a support member including a body portion contacting the bottom wall of the tray, the support member further including a pair of laterally spaced apart wings hingedly joined to the body portion and an end wall also hingedly joined to the body portion, the wings and the end wall forming a pocket for receiving a part of the support tray; and a protective member disposed about the tray so as to cover the food product.

2. The system of claim 1 further comprising a shield member disposed about the rim of the pan so as to shield an outer periphery of food product disposed in the pan during cooking.

3. The system of claim 2 wherein the shield member comprises an annular ring.

4. The system of claim 3 wherein the annular ring is formed from paperboard.

5. The system of claim 1 wherein the support tray central cavity defines a stepped recess, with a first recess portion receiving the sidewall of the pan and a second recess portion for receiving the rim of the pan.

6. The system of claim 5 further comprising a shield member disposed about the rim of the pan so as to shield an outer periphery of the food product disposed in the pan during cooking; and wherein the second recess portion also receives the shield member.

7. The system of claim 1 wherein said support member is formed of paperboard material with said wings and said end wall joined to said body portion by lines of weakness.

8. The system of claim 6 wherein the support member is secured to said tray with adhesive.

9. The system of claim 1 wherein said end wall of said support member is spaced from the first recess portion of said tray.

10. The system of claim 1 wherein said wings have edges abutting said end wall to determine the upright position of said tray when said packaging system is stood on said end wall.

11. A pre-packaged, uncooked deep dish pizza product, comprising in combination:

a pan for holding the deep dish pizza product, the pan having a bottom wall, a side wall and an upper outwardly extending rim;

a shield member in the form of an annular ring disposed about the rim of the pan so as to shield an outer periphery of food product disposed in the pan during cooking;

a support tray for securing the pan, deep dish pizza product and shield member, the support tray defining a stepped recess enclosed by a bottom wall, with a first recess portion receiving the side wall of the pan and a second recess portion for receiving the rim of the pan and the shield member; and a support member including a body portion contacting the bottom wall of the tray, the support member further including a pair of laterally spaced apart wings hingedly joined to the body portion and an end wall also hingedly joined to the body portion, the wings and the end wall foldable so as to form a pocket for receiving a part of at least one of the tray recess portions.

12. The system of claim 11 wherein the annular ring is formed from paperboard.

13. The system of claim 12 wherein the tray is formed from plastic with a concave center defining the stepped recess.

14. The system of claim 11 wherein said support member is formed of paperboard material with said wings and said end wall joined to said body portion by lines of weakness.

15. The system of claim 14 wherein the support member is secured to said tray with adhesive.

16. The system of claim 15 further comprising a protective film disposed about the tray so as to cover the food product.

17. The system of claim 11 wherein said end wall of said support member is spaced from the first recess portion of said tray.

18. The system of claim 11 wherein said wings have edges abutting said end wall to determine the upright position of said tray when said packaging system is stood on said end wall.

19. A food product packaging system comprising in combination:

a pan for holding the food product, the pan having a bottom wall, a side wall and an upper outwardly extending rim;

a support tray defining at least one cavity and a bottom wall at the bottom of the cavity, for securing the pan and the food product, the support tray defining a pocket to allow access to a user to lift the pan from the support tray, the tray also providing structural support for said tray in an upstanding position;

a protective member disposed about the tray so as to cover said at least one cavity; and a shield member disposed about the rim of the pan so as to shield an outer periphery of food product disposed in the pan during cooking.

20. The system of claim 19 wherein the shield member comprises an annular ring.

21. The system of claim 20 wherein the annular ring is formed from paperboard.

22. The system of claim 19 wherein the support tray central cavity defines a stepped recess, with a first recess portion receiving the sidewall of the pan and a second recess portion for receiving the rim of the pan.

23. The system of claim 19 wherein the annular ring is nested within the rim of the pan so as to remain in position with respect to the pan and the food product therein, during cooking.

* * * * *